US006778915B2

(12) United States Patent
Kelly et al.

(10) Patent No.: US 6,778,915 B2
(45) Date of Patent: Aug. 17, 2004

(54) ATHLETIC SWING TRAINER

(75) Inventors: Lawrence J. Kelly, Fairfield, OH (US); Bruce D. Rowe, Cincinnati, OH (US)

(73) Assignee: Force-4, LLC, Crescent Springs, KY (US)

( * ) Notice: Subject to any disclaimer, the term of this patent is extended or adjusted under 35 U.S.C. 154(b) by 110 days.

(21) Appl. No.: 10/285,182

(22) Filed: Oct. 31, 2002

(65) Prior Publication Data

US 2004/0088120 A1 May 6, 2004

(51) Int. Cl.[7] ..... G06F 19/00; F41F 1/00
(52) U.S. Cl. ..... 702/41; 124/41.1
(58) Field of Search ..... 702/41; 273/348; 473/222; 124/41.1

(56) References Cited

U.S. PATENT DOCUMENTS 4,291,663 A * 9/1981 Buck et al. ..... 124/26
4,442,823 A * 4/1984 Floyd et al. ..... 124/78
5,125,653 A * 6/1992 Kovacs et al. ..... 124/78
5,344,137 A * 9/1994 Komori ..... 124/36
5,649,523 A * 7/1997 Scott ..... 124/78
5,832,909 A * 11/1998 Grant et al. ..... 124/6
5,865,161 A * 2/1999 Bruce ..... 124/78
5,927,262 A * 7/1999 Bixler ..... 124/81
5,989,137 A * 11/1999 Krueger ..... 473/423
6,167,878 B1 * 1/2001 Nickerson et al. ..... 124/64
6,322,461 B1 * 11/2001 Walsh ..... 473/422
6,470,873 B2 * 10/2002 Battersby et al. ..... 124/78

* cited by examiner

*Primary Examiner*—Michael Nghiem
*Assistant Examiner*—Toan M. Le
(74) *Attorney, Agent, or Firm*—Wood, Herron & Evans, L.L.P.

(57) ABSTRACT

An apparatus, method and program product measure and analyze forces incident on a target. A support coupled to the target may move the target into a number of different initial positions. A force sensor embedded within the target may relay measured data to a controller that processes it to arrive at statistics and other displayable parameters.

42 Claims, 3 Drawing Sheets

ATHLETIC SWING TRAINER

FIELD OF THE INVENTION

The present invention relates generally to the field of athletic training equipment, and more particularly, to equipment used by athletes to practice arm swing technique.

BACKGROUND OF THE INVENTION

Developing improved hand-eye coordination and hitting techniques are athletic skills that improve with practice. Conventional practice methods may include use of pitching machines for baseball and tennis, where a ball is consistently projected or catapulted towards a stationary target near a hitter. Accuracy limitations inherent to such machines often translate into an inability to consistently deliver a ball in a desired, repeatable position. Such repetition may be desirable where a hitter and/or trainer wishes to focus a practice session on particular trouble areas. While a setting and orientation of a conventional machine may remain constant, the projected ball may nonetheless arrive at unpredictable heights, speed and relative horizontal position with respect to the hitter. Such imprecision can prevent a hitter maximizing benefits of practice and from realizing development that might otherwise be achieved with more accurate, repeatable ball placement. While the issue of repeatability may seem less critical in the context of a boxer striking a heavy bag, the bag will similarly fail to achieve focused positioning between consecutive punches that accurately reflects competitive and ideal training conditions.

Such imprecise presentation of a ball or other target often fails to realistically simulate game conditions, where athletes routinely face targets arriving at different heights, speeds and arm lengths. Moreover, batting cages and netted facilities typically used in conjunction with such machines often preclude definitive feedback on the speed, distance and trajectory that would be traveled by a batted ball but for the cage barrier. The absence of such feedback can detract from player gratification, as well as complicate efforts to gauge or measure individual improvement. Another drawback to such machines and associated structures concerns their relatively large space requirements, which can burden some athletic, arcade and other recreational facilities.

Consequently, what is needed is an improved manner of practicing, accommodating and evaluating swing techniques in a manner that more realistically simulates game conditions.

SUMMARY OF THE INVENTION

The invention addresses these and other problems associated with the prior art by providing in one respect an improved mechanism for measuring and analyzing forces incident on a target. A support coupled to the target may be configured to move the target into a number of different and repeatable initial positions. Thus, the target may be selectively or randomly presented to a user in any of the initial positions. The breadth of initial positions may correspond to locations where a user is likely to encounter a target during real game conditions. In this manner, the plurality of initial positions may benefit users desiring to practice and/or test their skills against a broad range of initial positions. As such, the range may translate into more comprehensive and realistic training of swing technique.

In some embodiments, initial positions may be collectively stored into "profiles." A stored profile may include coordinate and other data corresponding to suitable initial positions. Exemplary profiles may be either generic or customized for a particular user or application. Thus, a sequence of initial positions may be preprogrammed to enhance testing, skill development and user satisfaction as appropriate for a given training session.

In some embodiments, a controller may execute program code configured to actuate the support and target according the stored profile. More particularly, the controller may initiate movement of the target to the initial position as prescribed by the profile. The target may remain at the initial position until either the user contacts the target, or in some cases, until the expiration of a preset time increment. In one respect, suitable time increments may be configured to test and/or develop user reaction time. Another or the same embodiment may actuate the target continuously as it travels through a set or sequence of virtual coordinates corresponding to the initial position. The target may subsequently be presented to the user in a next occurring initial position as dictated by the profile.

In some embodiments, a sensor may be responsive to a force applied to the target. For this purpose, the force sensor may be embedded within or otherwise coupled to the target in order to detect and communicate measured force data to the controller. The controller may process the measured force data using recalled tables, kinematic equations and/or other algorithms to arrive at one or more parameters relating to the force incident on the target. The parameter may be useful in evaluating swing technique.

To this end, the parameter may be displayed to a user in a manner that both facilitates ready analysis and encourages further participation. Thus, by virtue of the foregoing there is provided an improved method, apparatus and program product for measuring and analyzing forces incident on a target in a manner that addresses above-identified shortcomings of known systems. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
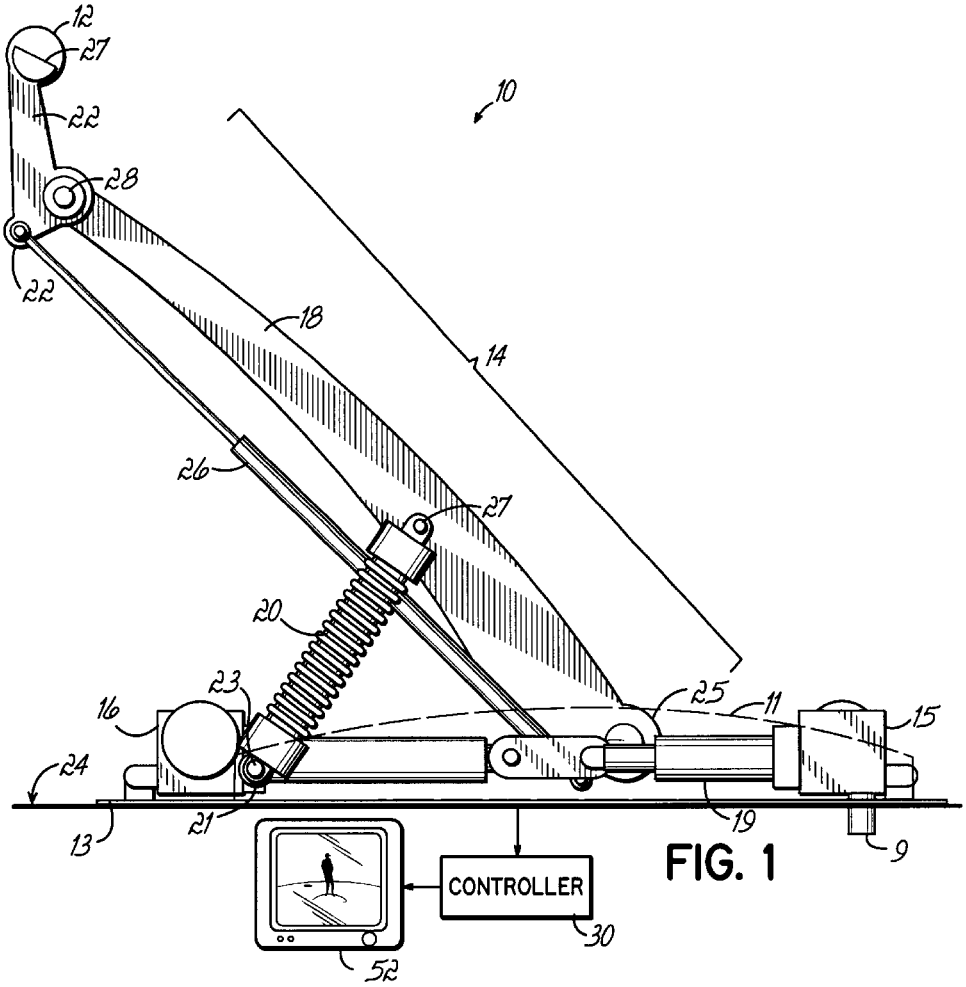
FIG. 1 illustrates an apparatus-suited for measuring force transferred to a target in accordance with the principles of the present invention.

An apparatus 10 consistent with the principles of the present invention is shown in FIG. 1. In one respect, the apparatus 10 measures and processes data indicative of force(s) incident on a target 12. While the target 12 illustrated in FIG. 1 has particular application within the sport of baseball, one skilled in the art should appreciate at the onset of this description that other suitable targets may include or otherwise be representative of a tennis ball, golf ball, soccer ball, racquet ball, punching bag and virtually any object having application within a sporting, therapeutic or recreational context. That is, an appropriate target 12 for purposes of the illustrated embodiment may pertain to any activity associated with arm or leg swinging techniques.

To this end, the apparatus 10 may include a support 14 that couples to the target 12. The materials used in the construction of the support 14 are not critical to the underlying principles of the present invention, but typically include use of a lightweight, durable, shatter-resistant material, such as a laminate, plastic, composite and/or a metal alloy. An exemplary support 14 may comprise a pendulum arm 18 that attaches to both a set of forward arms 20 and a breakaway support 22. In one embodiment, the breakaway support 22 may remain attached to the target 12 throughout the course of a training session. Another or the same embodiment may further incorporate a pneumatic cylinder 26 in communication with both the pendulum arm 18 and the breakaway support 22 for reasons developed below. Such exemplary components may cooperate to present the target 12 to a bat, racket, stick, club, foot or hand of a hitter.

Figure 5:
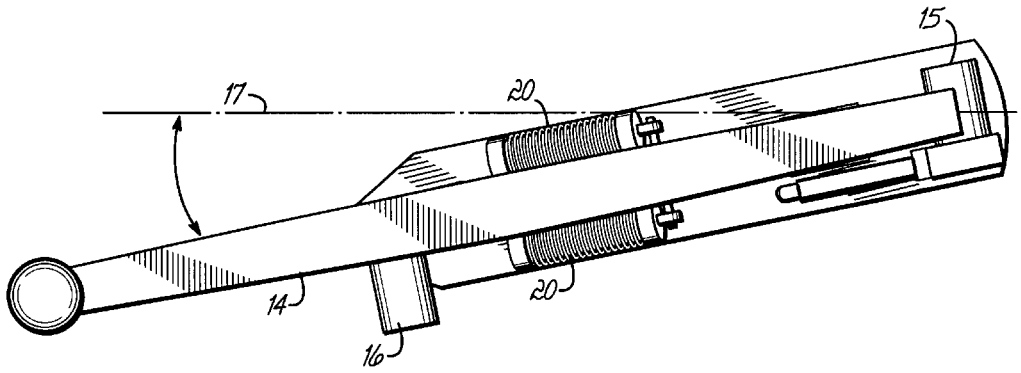
FIG. 5 is a top view of the apparatus of FIGS. 1 and 2.

The forward arms 20 may, in turn, couple to a rotatable base or carriage 11. While one skilled in the art should appreciate that inclusion of a carriage 11 is unnecessary, in certain embodiments, a suitable carriage 11 may nevertheless comprise any platform or structure configured to support one or more other components of the apparatus 10. Moreover, the carriage 11 may rotate on a track 13 to, in one respect, facilitate horizontal movement of the target 12. That is, a first actuator 15 coupled to the carriage 11, track 13 and/or base 24 may function to rotate the carriage 11 a desired angle off of a center line 17 as shown in FIG. 5. For instance, the first actuator 15 may extend, effectively rotating the carriage about a carriage pivot 9, along the track 13 to achieve a desired angle of rotation.

While greater rotation is possible, one embodiment may actuate the carriage 11 45° in either direction with respect to the center line 17.

A second actuator 16 may achieve target 12 motion along a vertical axis relative to the base 24. An end 26 of the pendulum arm 18 may attach to a slidable bracket 19. The bracket 19 may include bearings and/or a separate track to accommodate actuator 16 movement along the length of the carriage 11. As such, the bracket 19 may operatively couple to the second activator 16. Actuated movement of the bracket 19 may cause the pendulum arm 18 to pivot on the stationary forward arms 20. Movement of the bracket 19 along the axis of the carriage 11 towards the forward arms 20 may cause the pendulum arm 18 and attached target 12 to elevate. Conversely, the target 12 will lower where the second actuator 16 slides the bracket away from the forward arms 20.

The actuator 16 may move the support 14 vertically and/or horizontally, as well as forwards and backwards to position the attached target 12 at a desired location, or initial position, relative to a base 24 and hitter. For purposes of the illustrated embodiment, a suitable initial position may correspond to a target 12 location positioned within a striking range of the hitter. For instance, a support 14 consistent with the embodiment of FIG. 1 may position the target 12 within any number of programmably definable positions located within a virtual grid. For purposes of the embodiment shown in FIG. 1, a suitable grid may have coordinate dimensions that correspond to a strike zone for a given hitter.

As such, preprogrammed initial positions may include coordinate sets having an upper vertical boundary approximating shoulder height of a hitter and a lower boundary defined by a vertical orientation approaching knee level of a participant. Another application of the same embodiment may include initial positions exceeding those boundaries so as to account for positions located outside of the strike zone as dictated by individual training requirements and goals. Inclusion of such positions into a training regiment may serve to test the judgement and decision making capabilities of a hitter, while further emulating actual pitching scenarios and other game conditions.

As discussed below in greater detail, the parameters of a strike zone consistent with one embodiment of the invention may be programmable and customizable. For instance, the coordinates sets of initial positions utilized during a particular training session may be adjusted according to the heights and stances of a hitter. Moreover, the desired initial position may change over the course of a training session to satisfy training goals and/or to track game conditions. For example, a batter/trainer may wish for the apparatus 10 to present the target 12 in consecutive combinations of initial positions that correspond to a spectrum of pitched strike and ball positions encountered during a game. Another training application utilizing the apparatus 10 may limit the number of initial position(s) according to certain troublesome areas for which the player wishes to focus their practice.

As discussed below in detail, the apparatus 10 may "pop-up" or otherwise present the target to the hitter at the desired initial position for some preset duration, or time increment. The duration of an exemplary time increment may be tailored to glean timing data indicative of hitter reaction time and/or may be correlated to actual game conditions. For instance, the duration of the time increment may be generally representative of a window of time in which a hitter may have to decide whether to swing at a pitched ball. Additionally, an initial position for purposes of an embodiment of this invention includes an area, path and/or trajectory traveled by the target 12 during that time increment. Thus, it should be understood that the target 12 may be in motion as the initial position is achieved. Furthermore, an initial position for purposes of this description may include either a single set or sequential string of coordinates that at least partially define a path followed by the target 12.

In any case, the support 14 may move to a plurality of initial positions as dictated by a particular hitting session. For purposes of the embodiment shown in FIG. 1, the actuators 15, 16 may comprise any machine, engine, gear combination and/or other mechanism or grouping of devices capable of moving the target 12 and/or support 14 to the initial position. For instance, exemplary actuators 15, 16 may include electronically activated screw structures configured to tighten a cable or other connector in contact with the support 14 and/or carriage 11 such as to affect movement of the target 12.

Figure 2:
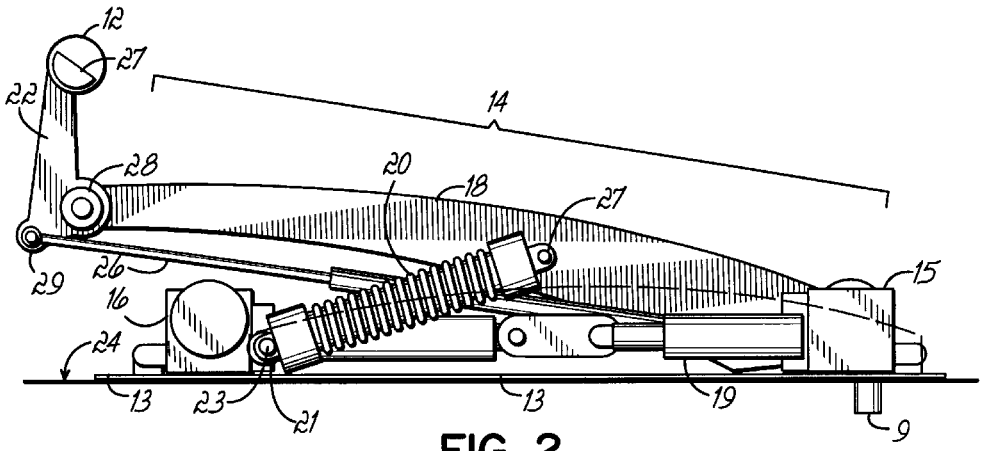
FIG. 2 illustrates the apparatus of FIG. 1 in a low-swing position.

In one embodiment, the second actuator 15 may couple directly to the pendulum arm 18. In this manner, the second actuator 16 may communicate a directional force through the bracket 19 and/or pendulum arm 18. The force generated by the actuator 16 may be sufficient to urge the pendulum arm 18 and target 12 into requisite reset and initial positions. To this end, the pendulum arm 18 may pivot on the forward arms 20, which may attach to the pendulum arm 18. Of note, while the exemplary carriage 11 as shown in FIGS. 1, 2 and 5 may have particular application in certain embodiments, another embodiment consistent with the principles of the invention may suspend a base end 25 of the pendulum arm 18 above the base 25 to facilitate freedom of movement. Another embodiment may contact the base end 25 of the pendulum 18 directly to the base 24. As such, the base end 25 may include wheels, bearings, smooth laminate, tracking or other mechanisms known to reduce friction between the support 14 and the base 24. The support 14, itself, may mount onto a swivel or other pivot mechanism attached to the carriage 11 and/or base 24 in such a manner as to accommodate a full range of motion appropriate for a given hitting application. Of note, a suitable pivot for a more limited application may comprise a simple hinge that allows only one dimensional movement of the support 14.

FIG. 2 illustrates the causal and connective cooperation of the components of apparatus 10 at an instant when the pendulum support 18 of FIG. 1 is moved to a lower position relative to the base 24. As such, the target 12 may achieve a lower position that might, for instance, correspond to the bottom of the programmably defined strike zone. As can be appreciated by one skilled in the art, the apparatus 10 components shown in FIGS. 1 and 2 may cooperate and interact with or without minor modifications to achieve a full range of motion of the support 14 as required by an athletic or therapeutic application.

Irrespective of the vertical and horizontal coordinates of the initial position, the breakaway support 22 may cooperate with the pneumatic cylinder 26 to generally maintain the orientation of the target 12. That is, the target 12 may remain above the breakaway support 22 relative to the base 24 when presented in the initial position, notwithstanding the actual location of the target within the strike zone. Preservation of such orientation may enable unobstructed access to the target 12 for a hitter swinging from hip level or higher. In operation, a pivot 28 on the breakaway support 22 may allow the target and breakaway support 22 to snap back in response to the swing of the hitter. In such an embodiment, a corner 29 of the breakaway support 22 may attach to an end of the pneumatic cylinder 26 such that the cylinder 26 accommodates the "breakaway" action of the support 14.

In one respect, the pneumatic cylinder 26 feature may impart to a hitter a realistic representation of how it feels to strike a baseball by controlling the amount of resistance encountered by the user at the point of target 12 impact. For instance, the resistance provided by the pneumatic cylinder 26 may be configured to simulate that which is typically encountered by a batter striking a fast pitched baseball. The resistance provided by the pneumatic cylinder 26 may double to return the breakaway support 26, and consequently, the target 12 to their pre-strike, original orientations. In addition to the benefits discussed above, this feature further may insulate the pendulum arm 18 and other components of the support 14 from harm that might otherwise result from direct or indirect contact with the bat.

Of note, other embodiments may orient the target 12 with respect to the support 14 such that it suspends from a breakaway support 22, cable or other structure. Such a configuration may have particular application in a soccer, martial arts or golf training scenario requiring a hitter to address the target 12 from an upward approach. Still another embodiment may account for varying heights of individual hitters by actively adjusting the position and/or orientation of the target 12 per data input directly by a user/trainer. Such input may relate to physical characteristics of the user, such as the height of the hitter, as well as other user or training preferences.

Figure 3:
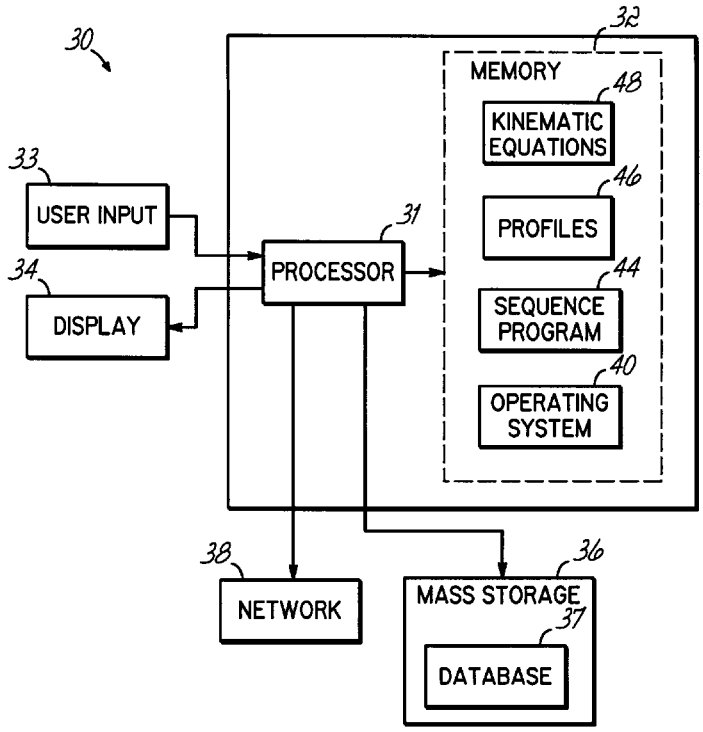
FIG. 3 shows a controller component of FIG. 1 in greater detail.

The actuators 15, 16 may move the target 12 into the initial position in response to a command originating from the controller 32. The block diagram of FIG. 3 shows a controller 30 suited to measure and analyze forces incident on a target 12 in accordance with the principles of the present invention. The exemplary controller 30 may comprise a microchip, transistor, computer, computer system or other programmable electronic device, or any combination of such devices.

Controller 30 typically includes at least one processor 31 coupled to a memory 32. Processor 31 may represent one or more processors (e.g., microprocessors), and memory 32 may represent the random access memory (RAM) devices comprising the main storage of controller 30, as well as any supplemental levels of memory, e.g., cache memories, non-volatile or backup memories (e.g., programmable or flash memories), read-only memories, etc. In addition, memory 32 may be considered to include memory storage physically located elsewhere in controller 30, e.g., any cache memory in a processor 31, as well as any storage capacity used as a virtual memory, e.g., as stored within a mass storage device 36 or on another computer coupled to controller 30 via network 38.

Controller 30 also may receive a number of inputs and outputs for communicating information externally. For interface with a batter, trainer or other user, controller 30 typically includes one or more input devices 33 (e.g., a foot pedal, a motion sensor, a keyboard, a mouse, a joystick, a touchpad and/or microphone, among others) and a display 34 (e.g., a CRT monitor, an LCD display panel, and/or a speaker, among others). It should be appreciated, however, that with some implementations of controller 30, e.g., some server implementations, direct user input and output may not be supported by the controller 30, and interface with the controller 30 may be implemented through a remote computer or workstation networked with controller 30. For instance, a trainer may initiate a sequence program 44 and monitor a training session from a remote vantage.

For additional storage, controller 30 may also include one or more mass storage devices 36 configured to store a database 37. Exemplary mass storage devices 36 can include: a floppy or other removable disk drive, a hard disk drive, a direct access storage device (DASD), an optical drive (e.g., a CD drive, a DVD drive, etc.), and/or a tape drive, among others. Furthermore, controller 30 may include an interface with one or more networks 38 (e.g., a LAN, a WAN, a wireless network, and/or the Internet, among others) to permit the communication of information with other computers coupled to the network. It should be appreciated that controller 30 typically includes suitable analog and/or digital interfaces between processor 31 and each of components 32, 33, 34, 36 and 38.

Controller 30 may operate under the control of an operating system 40, and may execute various computer software applications, components, programs, objects, modules, etc. (e.g., sequence program 44, profiles 46, kinematic equations 48). Moreover, various applications, components, programs, objects, modules, etc. may also execute on one or more processors in a computer coupled to controller 30 via a network 38, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions will be referred to herein as "computer programs," or simply "programs" or "code." Furthermore, program code may be interpreted as comprising multiple, distinct programs or algorithms used throughout an entire programmatic sequence or operation. The computer programs typically comprise one or more instructions that are resident at various times in various computer memory and storage devices. When a program is read and executed by a processor, the program causes the controller to execute steps or elements embodying the various aspects of the invention.

Moreover, while the invention has and hereinafter will be described in the context of fully functioning controllers and computer systems, those skilled in the art will appreciate that the various embodiments of the invention are capable of being distributed as a program product in a variety of forms, and that the invention applies equally regardless of the particular type of signal bearing media used to actually carry out the distribution. Examples of signal bearing media include, but are not limited to recordable type media such as volatile and non-volatile memory devices, floppy and other removable disks, hard disk drives, optical disks (e.g., CD-ROM's, DVD's, etc.), among others, and transmission type media such as digital and analog communication links.

In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

The command transmitted from the controller 30 to the actuators 15, 16 may convey, among other parameters, a set of three-dimensional coordinates that correspond to the initial position. As such, suitable coordinates can describe a plurality of locations within a strike zone or other programmatically describable, designated space. Thus, an embodiment of the present invention may allow users to practice a broader and more varied range of swing paths and target positions than with conventional machines and training practices. Of note, the transmission of the command from the controller 30 in one embodiment may be contingent upon a hitter first depressing a foot petal or other enabling switch proximate the support 14. Another or the same petal may pause a simulation session, allowing a hitter to initiate a short period to regroup, analogous to a batter initiating a "time-out."

A subsequent, reset command from the controller 30 may follow the first command after the expiration of short time increment. The reset command may instruct the actuators 15, 16 to remove the target 12 from the initial position. For instance, the reset command may cause the target 12 to return to a predefined intermediate position out of the reach and/or view of the batter. The apparatus 10 may automatically return the support 14 and target 12 to the reset position when not in use.

In one embodiment, the target 12 may remain at the initial position only for the duration of the above discussed, preset time increment. This increment may correspond to a window of time spanning the time a pitch approaches a batter's box to a subsequent point in time when it is too late for the batter to swing at and hit it. That is, the time increment may correlate to the span of time a batter typically has to decide whether to hit a pitched baseball. To this end, the apparatus 10 may present the target 12 to the hitter for an increment ranging from about 0.15 seconds to about 0.20 seconds prior to returning the target 12 to the reset position. A product of the "pop-up target" feature of the embodiment may include improved reaction times, as well as increased hitter focus regarding visual association of the target 12 with the bat, "looking the ball into the bat." Of note, an operator may adjust the above exemplary range substantially and as necessary to account for player skill level and developmental goals.

To this end, the controller 30 may execute a stored sequence program 44 recalled from the database 37 or other memory 32. The sequence program 44 may include a collection of coordinates defining one or more initial positions. Each initial position may be accompanied within the program 44 by an associated time increment. The increment may stipulate for how long the target 12 will remain at the initial position prior to returning to the reset position. Alternatively, the initial position and/or time increments may be preset into the controller 30 hardware. In either case, the sequence program 44 may cause the target 12 to be presented to the batter at a subsequent, preprogrammed desired location for a duration specified by the sequence program 44.

The sequence program 44 may further define a virtual grid of programmatic coordinates used by the controller as a basis for interpreting coordinate and other profile 46 data. That is, the grid in one respect may programmatically overlay a set of like or similar hardware coordinates useful to facilitate translation between the initial position and a hardware actuator 16/support 14 setting. For instance, a virtual grid suited for the application shown in FIG. 1 may include and define dimensions of strike zone.

Suitable sequence programs 44 may vary as a function of user proficiency and training goals. For instance, a batter may wish to practice hitting pitches thrown toward the inside of home plate. Consequently, the batter or trainer may initiate a sequence program 44 scenario featuring a propensity of initial positions having preprogrammed coordinates correlated the batter-side of a virtual strike zone.

Another sequence program 44 executed by the controller 30 may include an evaluative function. For instance, a program 44 in accordance with the embodiment may test swing accuracy at various, desired points in and outside of the strike zone to ascertain hitting strengths and weaknesses of a batter. Similarly, a trainer may glean information pertinent to a hitter's reaction time after reviewing the results of the hitting session. A suitable sequence program 44 may vary the consecutive positions of the target 12, as well as the intervals between presenting the targets. Another or the same sequence program 44 may include random programming selection, and may further vary the time increment the target 12 remains at the desired location as required per an application.

The controller 30 may additionally receive and process signals received from a force sensor 27. The type of force sensor 27 employed may vary according to the type of incident forces meant to be detected by a given apparatus 10. Such measurements may include, but are not limited to, the magnitude and angle of forces incident on the target 12. To this end, the force sensor 27 may be integral with the target 12. For instance, an accelerometer or other sensor 27 may be embedded within the target 12 as shown in FIG. 1. While such a configuration presents certain advantages, it should be appreciated that other suitable configurations may include force sensors distant from the sensor, such as a laser or camera device trained on the target 12 and/or in communication with the support 14.

An accelerometer employed as a force sensor 27 in accordance with the principles of the present invention may generate a charge proportional to the inertia/acceleration experienced by memory alloys housed within the accelerometer casing. As such, the charge from the accelerometer may be proportional to the acceleration experienced by the target 12 in response to being struck by the bat. Of note, while the small size and robust attributes of an accelerometer lend credence to its use in the illustrated apparatus 10, other known force, size and velocity measurement devices/configurations may be alternatively or additionally employed to ascertain data useful in calculating desired parameters. Thus, for purposes of this disclosure, a force sensor 27 may include a measurement device capable of capturing data that may be merely indicative of force, in addition to other describable attributes.

In the embodiment shown in FIG. 1, the apparatus 10 may communicate the charge from the force sensor 27 to the controller 30. Such acceleration information has application in kinematic equations, tabled data, and other applications useful in deriving parameters descriptive of the forces incident on the target 12. Thus, the controller 30 may exploit the acceleration information conveyed in the charge to arrive at useful force analysis. For instance, the controller 30 may process the acceleration data conveyed by the charge to calculate a distance that the ball/target 12 would travel in response to the contact from a user's bat. Other exemplary parameters calculated by the controller 30 in response to a contact may relate to a calculated ball direction, speed and/or trajectory. Of note, algorithms used to calculate such parameters may account for real world conditions, such as frictional forces attributable to wind speed. Moreover, one skilled in the art should appreciate that stored tables may be utilized in the alternative or in addition to algorithms, where desired for processing or other considerations.

Other parameters determined by the controller 30 may relate to what particular point on the surface of the target 12 received the brunt of a bat's impact, as well as how fast the bat was traveling at the instant of impact. Still another parameter may regard how quickly a batter reacts to, or strikes, the target 12 from the time the support 14 initially presents it to the batter. To this end, the controller 30 may access numerous stored algorithms configured to arrive at these and other parameters useful in swing analysis. Moreover, while such parameters may have particular relevance within the field of baseball, it should be appreciated that any number of additional parameters appropriate to other recreational and therapeutic endeavors may be computed using known detection devices, to include a radar or laser configuration operable to measure velocity or ball rotation.

The computed parameters may be reported to the hitter, trainer and/or other party via a configurable and interactive display 52. The display 52 may include features specifically suited to the parameters required by a particular application of the apparatus 10. For instance, a display 52 suited for the embodiment shown in FIGS. 1 and 2 may utilize a liquid crystal display 52 to project video or animation. The display 52 may show data suggestive of a stadium or other arena played back or generated on a screen from the perspective of a batter at home plate looking toward the pitcher's mound. As such, certain parameters may be visually communicated to the hitter by, for instance, projecting a batted baseball trajectory onto the display 52 in response to contact initiated with the target 12.

Input used to construct the simulation may be computed or otherwise derived from forces resulting from the batter's contact with the target 12. That is, the displayed path of the baseball may reflect distance, trajectory and/or direction parameters computed from forces incident on the target 12. Such a display 52 may communicate parameters to a batter/trainer in an easily digestible and familiar format that can further encourage more practice by preserving aspects of a sport that emulate actual competition and game conditions. Of note, an exemplary display 52 of interchangeable stadium settings, courts or other forums can easily be altered or substituted for training or preferential considerations. An alternative or additional feature of a display 52 may present a printed or digital text readout conveying parameters in a prescribed format.

The display 52 may further incorporate other audio and video features intended to both train and amuse batters. For instance, the display 52 for the baseball application of FIGS. 1 and 2 may project video or animation of a pitcher's wind-up, to include the pitcher throwing a computer generated "ball" in the direction of the initial position. The video playback may be synchronized with the program sequence to allow a batter to gauge their swing according to game simulated conditions. Such a display may further incorporate audio, such as a "sizzling" sound simulating noise made by an approaching baseball. The audio could account for surround sound and Doppler effect considerations, as well as recorded stadium noise to further enhance realism and player satisfaction. One skilled in the art can anticipate that any number of audio and visual cues may be used in conjunction with the display 52 in a manner consistent with the principles of the present invention.

The controller 30 may initiate storage of the statistics and other parameters in database fields linking the stored information to the hitter. In a training setting, such parameter data stored over the course of multiple sessions may be compared to later sessions to quantify improvements in, for instance, swing accuracy and player reaction time. Program code executed by the controller 30 may further process the parameter data to arrive at a point rating or score. An operator/trainer may use the point rating as a reference for evaluation purposes. Similarly, parameters and/or a score derived therefrom may be stored in a competitive arcade context to rank game contestants and maintain a record of high scores.

Figure 4:
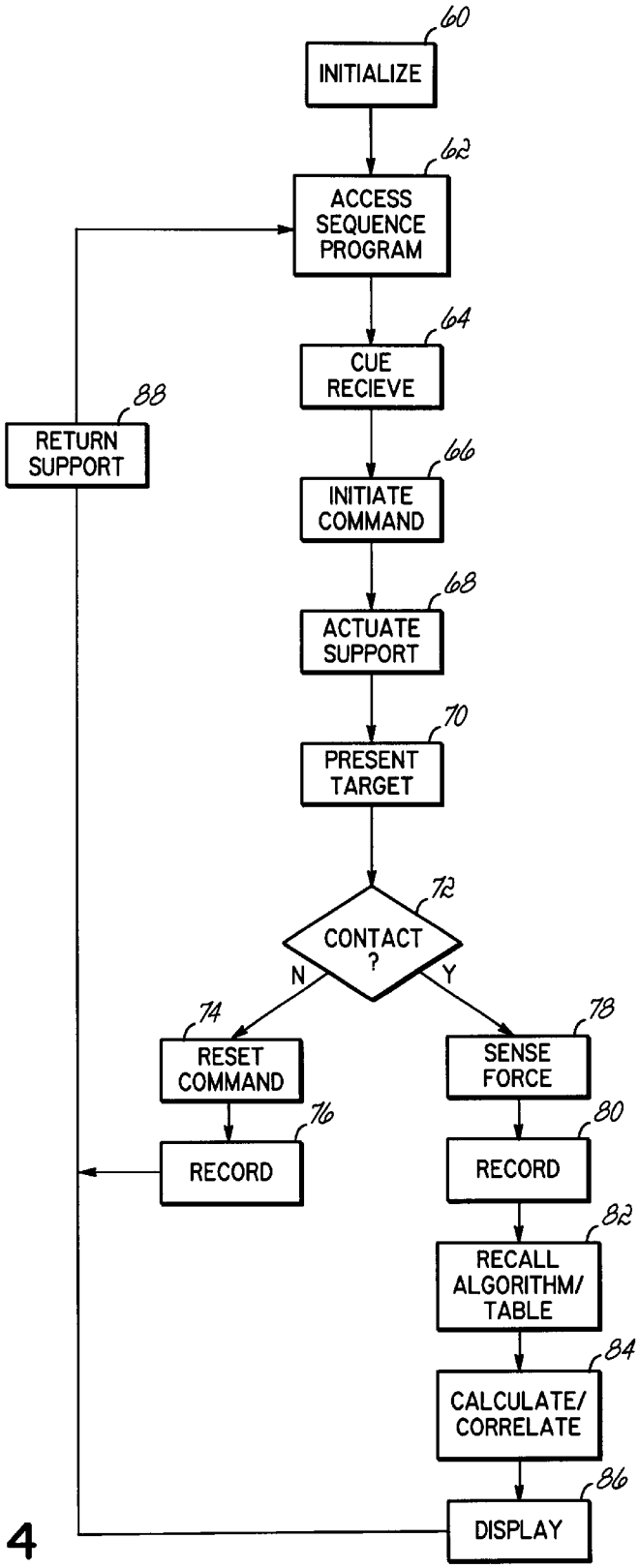
FIG. 4 is a flowchart outlining sequenced steps suited for execution within the context of the apparatus shown in FIGS. 1 and 2.

FIG. 4 illustrates a flowchart having sequenced steps suitable for execution in the context of the apparatus 10 shown in FIGS. 1 and 2. That is, the steps of FIG. 3 may be performed to measure force incident on a target 12 in a manner that is consistent with the principles of the present invention. Turning more particularly to the flowchart of FIG. 4, a user may initialize or boot-up the apparatus 10 at block 60. Initialization procedures occurring at block 60 may include the user depressing a foot pedal, switch, lever or button proximate the support 14. In another embodiment, a trainer observing a hitting session from a distance may initiate the apparatus 10 using remote control circuitry. Of note, processes executed at block 60 may initialize visual and auditory cues at the display 52 intended to alert a user. For instance, an exemplary display 52 may prompt animation or streaming video of a pitcher's windup and delivery.

At block 62, the apparatus 10 may access a sequence program 44 correlated to particular application and/or hitter profile 46. As such, the sequence program 44 may link to or otherwise access information pertaining to a particular hitting regiment or training plan. To this end, an exemplary sequence program 44 may include initial positions for the target 12 that correspond to pitches thrown toward the outside of a predefined strike zone. Another sequence program 44 may include a repetitive initial position, or a predictable sequence of initial positions useful in ascertaining skill level. As discussed herein, the program 44 may convey any number of sequential initial positions, as well as time increments corresponding to those initial positions. The duration of the time increments may vary as between consecutive initial positions to simulate different ball speeds and/or to more broadly ascertain batter reaction times. Similarly, a profile 46 accessed by the sequence program 44 may draw data from at least one coordinate set, time increment, position sequence, reset position, initial position, user preferences, user physical characteristics, prior use and/or historical rating data (past point scoring).

In one embodiment, the apparatus 10 may accommodate a ready signal initiated by the hitter at block 64. Such a feature may parallel actual game activity where a batter steps away from the batter's box in between pitches. As such, a batter may depress a foot pedal or speak into a microphone at block 64 to cue the sequence program 44 as to the readiness of the batter. In any case, the controller 30 may send a command at block 66 as dictated by the sequence program 44. The command may convey coordinate and position data, as well as other instructions readable by the actuators 15, 16. In response to the command from the controller 30, the actuators 15, 16 may move the support 14 and target 12 to the prescribed initial position at block 68. Suitable initial positions may include any number of programmably defined sets of three dimensional coordinates within the range of motion of the support 14. As such, the apparatus 10 may present the target 12 at block 70 to the batter for the duration of a preset time increment. In this manner, the presentation of the target may last for around 0.20 seconds, or a time approximating how long a batter may have to react to a thrown pitch.

An embodiment of the apparatus 10 registers any contact or force incident on the target 12 at block 72. For instance, a force sensor 27 in communication with the target 12 may generate a charge indicative of a contacting force at block 72. If no force is detected at block 72, i.e., the batter fails to contact the target 12 during the preset time increment, then the sequence program 44 may initiate a reset command at block 74. The reset command may initiate the actuators 15, 16, returning the support 14 and target 12 to a reset position at block 88. When appropriate, the fact that no force was incident on the target during the span of the time increment may be recorded at block 76 for later analysis. Such information may be useful in determining what percentage of pitches presented within a strike zone a batter elected not to swing at. Depending upon the training regiment of a batter, a sequence program 44 may prepare to present the target 12 to another or the same initial position at block 62.

Where a batter strikes the target 12 at block 72, then the system may record forces incident on the target 12 at block 78. For example, the force sensor 27 in communication with the target 12 may relate a force measurement to the controller 30. The force measurement data may be recorded at block 80 for calculation and analysis/trend purposes. The controller 30 at block 82 may further recall an algorithm, table and/or other calculating device suited to process the force measurement data at block 84. As such, the controller 30 may process the force measurement data according to the recalled algorithm and/or table. One embodiment may calculate a ball trajectory based upon vector forces and invoked kinematic equations. Another or the same embodiment may determine the distance that a target 12 might have traveled given the force measurement recorded at block 80 in view of tabled calculations. Such an embodiment may require fewer processing cycles of the controller 30 to arrive at required parameters. Of note, tables and algorithms utilized by the apparatus 10 may account for frictional forces encountered during actual play such as wind frictional forces.

Parameters calculated at block 84 may be displayed to a hitter at block 86. An exemplary display 52 may include a digital simulation of a ball's flight in a stadium or other setting. In this manner, the display 52 may communicate parameters to the user and/or trainer such as ball distance, direction and trajectory. Other parameters may relate to a contact point on the target 12, hitter reaction time, trajectory and bat speed, among others. While not limited to such, display mechanisms used to convey the parameters and other statistical information to a user may include animation, graphical representations, audio, video LED's, as well as electronic/printed readouts and scores. The apparatus 10 may simultaneously return the support 14 to the reset position at block 88 in anticipation of a next target 12 presentation.

While the present invention has been illustrated by a description of a baseball embodiment, and while the embodiment have been described in considerable detail, it is not the intention of the applicant to restrict or in any way limit the scope of the appended claims to such detail. For instance, while a single controller 30 of one embodiment may both initiate movement of the support and calculation of a force parameter, these tasks may be distributed among multiple controllers in another application. Moreover, "controller" for purposes of the present invention should be broadly construed to include, in addition to instrumented devices, such devices that are all or largely mechanical, such as a combination of levers, dial settings and/or pulleys, for instance, configured to move target 12 to the initial positions in the absence of electronic programming. As discussed herein, the principles of the invention apply equally to other sporting and recreational endeavors, to include boxing, golf, hockey, squash, tennis and virtually any activity where a participant strikes an object to realize a specific effect.

Furthermore, embodiments of the present invention have particular application within an arcade setting, where users may play out innings/sets/courses, or practice particular skill sets, such as home run hitting. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An apparatus for measuring a force incident on a sports-related target, comprising:

a support coupled to a target and moveable to one of a plurality of initial positions;

a force sensor in communication with the target and responsive to a force applied to the target; and a controller in communication with the force sensor and operable to initiate movement of the support to one of the plurality of initial positions, the controller further being configured to calculate a parameter relating to the force incident on the target.

2. The apparatus according to claim 1, wherein the target remains coupled to the support after receiving the force.

3. The apparatus according to claim 1, wherein the controller initiates movement of the support in response to the force applied to the target.

4. The apparatus according to claim 1, wherein the controller initiates movement of the support to a reset position subsequent to sensing the force applied to the target.

5. The apparatus according to claim 1, wherein the support moves from the initial position to a reset position after a preset time increment expires.

6. The apparatus according to claim 1, wherein the parameter relates to a performance attribute selected from a group consisting of: an impact point on the target, reaction time, trajectory, distance, spin, direction, target velocity, swing velocity, acceleration and some combination thereof.

7. The apparatus according to claim 1, wherein the target is representative of an item selected from a group comprising: a sports ball, a puck, a punching bag, a mannequin, a clay pigeon and some combination thereof.

8. The apparatus according to claim 1, wherein the controller initiates a display communicative of the parameter.

9. The apparatus according to claim 8, wherein the display includes at least one feature selected from a group consisting of: animation, a graphical representation, audio, video, a still frame, a printout, an electronic readout and some combination thereof.

10. The apparatus according to claim 1, wherein the controller initiates storage of the parameter in a memory for later use.

11. The apparatus according to claim 1, wherein the controller determines the initial position according to a stored profile.

12. The apparatus according to claim 1, wherein the profile includes information relating to target presentation data selected from a group consisting of: at least one coordinate set, time increment, position sequence, reset position, initial position, user preferences, user physical characteristics, prior use, historical rating data and some combination thereof.

13. The apparatus according to claim 1, further comprising an actuator operatively coupled to move the support in a direction selected from a group consisting of: horizontal, vertical, forward, backward and some combination thereof.

14. The apparatus according to claim 13, wherein movement of the actuator is initiated using an input device selected from a group consisting of: a pedal, switch, button, microphone, motion sensor, weight sensor, and some combination thereof.

15. The apparatus according to claim 1, wherein the controller initiates movement of the support in response to input from a user.

16. The apparatus according to claim 1, wherein the controller initiates determination of the parameter using factors relating to preset frictional forces.

17. The apparatus of claim 1, wherein the support includes a pneumatic cylinder.

18. The apparatus of claim 1, wherein the support includes a breakaway support coupled to the target.

19. The apparatus according to claim 1, wherein the force sensor includes a detector selected from a group consisting of: an accelerometer, laser, radar, photosensor, gyroscope, scale and some combination thereof.

20. The apparatus according to claim 1, wherein the force sensor is embedded within the target.

21. The apparatus of claim 1, wherein the controller initiates retrieval of an algorithm useful in processing the sensed force into the parameter.

22. A method for evaluating a force incident on a sports-related target, comprising;

moving a support coupled to a target to one of a plurality of initial positions in accordance with a command from a controller coupled to the support;

sensing the force using a force sensor in communication with the target; and determining a parameter relating to the force incident on the target.

23. The method according to claim 22, wherein sensing the force using the force sensor in communication with the target further comprises maintaining contact between the target and the support after being struck.

24. The method according to claim 22, wherein sensing the force using the force sensor in communication with the target further comprises moving the support in response to the force applied to the target.

25. The method according to claim 22, wherein sensing the force using the force sensor in communication with the target further comprises moving the support to a reset position subsequent to sensing the force applied to the target.

26. The method according to claim 22, wherein sensing the force using the force sensor in communication with the target further comprises moving the support from the initial position to a reset position after a preset time increment expires.

27. The method according to claim 22, wherein determining the parameter relating to the force incident on the target further comprises selecting the parameter from a group consisting of: an impact point on the target, reaction time, trajectory, distance, direction, target velocity, spin, swing velocity, acceleration and some combination thereof.

28. The method according to claim 22, further comprising selecting the target from a group comprising: a sports ball, a puck, a punching bag, a mannequin, a clay pigeon and some combination thereof.

29. The method according to claim 22, further comprising initiating a display communicative of the parameter.

30. The method according to claim 29, wherein initiating the display communicative of the parameter further comprises selecting a feature of the display from a group consisting of: animation, a graphical representation, audio, video, a still frame, a printout, an electronic readout, and some combination thereof.

31. The method according to claim 22, wherein determining the parameter relating to the force incident on the target further comprises storing the parameter within a memory for later use.

32. The method according to claim 22, wherein moving the support coupled to the target to one of the plurality of initial positions further comprises determining the initial position from a stored profile.

33. The method according to claim 32, wherein determining the initial position from the stored profile further comprises including within the stored profile information relating to target presentation data selected from a group consisting of: at least one coordinate set, time increment, position sequence, reset position, initial position, user preferences, user physical characteristics, prior use, historical rating data and some combination thereof.

34. The method according to claim 22, wherein moving the support coupled to the target to one of the plurality of initial positions further comprises moving the support in a direction selected from a group consisting of: horizontal, vertical, forward, backward and some combination thereof.

35. The method according to claim 22, wherein moving the support coupled to the target to one of the plurality of initial positions further comprises initiating movement of the support using an input device selected from a group consisting of: a pedal, switch, button, microphone, motion sensor, weight sensor, and some combination thereof.

36. The method according to claim 22, wherein moving the support coupled to the target to one of the plurality of initial positions further comprises initiating movement of the support in response to input from a user.

37. The method according to claim 22, wherein determining the parameter relating to the force incident on the target further comprises initiating determination of the parameter using factors relating to preset frictional forces.

38. The method according to claim 22, wherein sensing the force using the force sensor in communication with the target further comprises selecting the force sensor from a group consisting of: an accelerometer, laser, radar, photosensor, gyroscope, scale and some combination thereof.

39. The method according to claim 22, wherein sensing the force using the force sensor in communication with the target further comprises embedding the force sensor within the target.

40. The method according to claim 22, wherein determining the parameter relating to the force incident on the target further comprises initiating retrieval of an algorithm useful in processing the sensed force into the parameter.

41. A program product, comprising:

a program for measuring and processing data relating a force incident on an target, the target coupling to a support and being moveable to one of a plurality of initial positions, wherein the program code is configured to initiate movement of the support to move the target; wherein a force sensor in communication with the target and responsive to the force applied to the target further communicates with a controller configured to execute the program and calculate a parameter relating to the force incident on the target; and a signal bearing medium bearing the program.

42. The program product of claim 41, wherein the signal bearing medium includes at least one of a recordable medium and a transmission-type medium.

* * * * *

UNITED STATES PATENT AND TRADEMARK OFFICE

CERTIFICATE OF CORRECTION

PATENT NO. : 6,778,915 B2 
DATED : August 17, 2004
INVENTOR(S) : Lawrence J. Kelly and Bruce D. Rowe It is certified that error appears in the above-identified patent and that said Letters Patent is hereby corrected as shown below:

Column 2,
Line 48, please delete the hyphen between the words "apparatus" and "suited" so that it reads as "apparatus suited"

Column 3,
Lines 39-40, please delete the paragraph indentation at line 40 so the sentence beginning with the word "While" continues at the end of the last sentence of the paragraph on line 39 ending with the word "rotation."

Signed and Sealed this

Twenty-second Day of March, 2005

JON W. DUDAS
*Director of the United States Patent and Trademark Office*